US007296432B2

(12) United States Patent
Müller et al.

(10) Patent No.: US 7,296,432 B2
(45) Date of Patent: Nov. 20, 2007

(54) REFRIGERATOR HOUSING

(75) Inventors: Volker Müller, Hilchenbach (DE); Manfred Lorek, Siegen (DE)

(73) Assignee: Dometic GmbH, Siegen (DE)

( * ) Notice: Subject to any disclaimer, the term of this patent is extended or adjusted under 35 U.S.C. 154(b) by 650 days.

(21) Appl. No.: 10/509,807

(22) PCT Filed: Apr. 4, 2003

(86) PCT No.: PCT/EP03/03557

§ 371 (c)(1),
(2), (4) Date: Sep. 30, 2004

(87) PCT Pub. No.: WO03/085339

PCT Pub. Date: Oct. 16, 2003

(65) Prior Publication Data

US 2005/0200252 A1 Sep. 15, 2005

(30) Foreign Application Priority Data

Apr. 5, 2002 (DE) ..... 102 15 120
Apr. 5, 2002 (DE) ..... 102 15 177
Dec. 5, 2002 (DE) ..... 102 56 954

(51) Int. Cl.
*F25D 11/00* (2006.01)
*F25D 11/02* (2006.01)

(52) U.S. Cl. ..... 62/440; 62/444; 312/286; 264/255

(58) Field of Classification Search ..... 62/DIG. 13, 62/440, 444, 458, 100, 236, 259.1; 312/283, 312/286; 264/255, 267, 275
See application file for complete search history.

(56) References Cited

U.S. PATENT DOCUMENTS 2,095,847 A * 10/1937 Willat ..... 62/168
3,989,328 A * 11/1976 Nonomaque et al. .... 312/406.2
4,123,130 A * 10/1978 Locke ..... 312/285
4,199,205 A * 4/1980 Cooke et al. ..... 312/406
4,609,234 A 9/1986 Naniwa et al.
4,725,107 A * 2/1988 Appleton ..... 312/283
5,473,901 A * 12/1995 Roseen ..... 62/45.1
5,638,896 A * 6/1997 Nishino et al. ..... 165/132
5,765,379 A * 6/1998 Jensen ..... 62/45.1
6,101,819 A 8/2000 Onaka et al.
6,109,712 A 8/2000 Haworth et al.
6,150,026 A * 11/2000 Furuya et al. ..... 428/424.8

(Continued)

FOREIGN PATENT DOCUMENTS

DE 86 29 578 2/1987

(Continued)

*Primary Examiner*—Mohammad M. Ali
(74) *Attorney, Agent, or Firm*—Pearne & Gordon LLP

(57) ABSTRACT

Refrigerator housing including an one-piece external housing made (6) from synthetic material; an internal housing (1) made (6) from synthetic material, which forms a cooling compartment and comprises an access opening (2); said external housing (6) and said internal housing (1) being in sealed manner connected to one another in the region of said access opening (2) on the front side, welded together or glued together in particular, and a hollow space (12) serving for isolation being formed between internal housing (1) and external housing (6); said external housing (6) on its rear side comprising an opening (11) through which essentially the entire hollow space is accessible for introducing isolation material.

20 Claims, 9 Drawing Sheets

U.S. PATENT DOCUMENTS 6,209,265 B1 4/2001 Banicevic et al.

FOREIGN PATENT DOCUMENTS

| | | | | |
|---|---|---|---|---|
| DE | 197 12 140 | A | | 9/1998 |
| DE | 197 45 826 | A1 | | 4/1999 |
| DE | 198 08 227 | A1 | | 9/1999 |
| EP | 0 660 448 | A2 | | 6/1995 |
| EP | 0 753 710 | A | | 1/1997 |
| FR | 2 452 685 | | | 10/1980 |
| GB | 2 175 384 | A | | 11/1986 |
| GB | 2 191 852 | A | | 12/1987 |
| JP | 5-65180 | A | * | 3/1993 |

* cited by examiner

REFRIGERATOR HOUSING

The invention relates to a refrigerator housing as defined in the preamble of claim 1, said housing preferably being used for absorption refrigerators, for hotel refrigerators or refrigerators in caravan vehicles in particular.

Traditionally, refrigerator housings are assembled from several individual components which can be fitted into one another. Said multi-component composed housing comprises a hollow space between an internal housing and an external housing, said hollow space being filled with isolating material. However, filling with isolation material creates the problem that the assembled housing parts are not very stable and in addition sealing has to be provided for between the assembled components for avoiding exit of isolation material. This problem occurs in increased manner in case of the filling material being polyurethane foam since this foam penetrates through the gaps of the assembled housing components.

From EP 0936428 A2 a refrigerator housing made from synthetic material, in accordance with the preamble of claim 1 is known. Said housing consists of an one-piece internal housing forming the cooling compartment and comprising an access opening, as well as of an external housing connected thereto. External and internal housing therein are welded together along said access opening so that a closed hollow space is formed between internal housing and external housing, which space for isolation purpose can be evacuated using a vacuum pump. In this housing it turns out to be disadvantageous that internal housing and external housing are built in shape of a trough so that after welding together of the two housing parts it is no longer possible to provide for isolation material in the hollow space created therebetween. As a consequence the hollow space had to be filled with isolation material prior to connecting the housing parts, this rendering the manufacturing process of said refrigerator housing complicated.

In EP 0 587 456 B1 a refrigerator housing is disclosed, having an hermetically sealed hollow space between an internal housing and an external housing. In this housing, too, subsequent filling with isolation material is not possible.

In the patent specification GB 840 855 a refrigerator housing of synthetic material is shown, comprising an external part and an internal part, between which a hollow space is provided for which is filled with foamed synthetic material for isolation. Said hollow space is filled from the front side of the housing and subsequently a frame is inserted into said front side between external part and internal part for sealing said hollow space. In this refrigerator housing, too, the problem arises that during filling with isolation material said inner part and said outer part are not mutually connected.

It, therefore, is the object of the present invention to create a refrigerator housing which can be manufactured in more simple manner and at lower costs than the refrigerator housings under the state of art.

This object is solved by the refrigerator housing as defined in claim 1. Preferred embodiments of said refrigerator housing are subject of the depending claims.

The refrigerator housing in accordance with the present invention includes an one-piece external housing made from synthetic material as well as an one-piece internal housing also consisting of synthetic material, forming a cooling compartment and comprising an access opening. Said external housing and said internal housing in the area of said access opening on the front side are mutually connected in sealing manner, welded together or glued together in particular, and an isolating hollow space is formed between said internal housing and said external housing. Said external housing therein is embodied such that on its rear side it comprises an opening through which essentially the entire hollow space is accessible for introducing isolation material. Thereby filling of said hollow space with isolation material subsequently to welding together or glueing, respectively, together of said internal housing and said external housing is rendered possible so that it is not required to position internal housing or external housing by corresponding devices for filling purposes. Rather is a self-supporting housing formed after welding together of said internal housing and said external housing, whose shape predefines the hollow space. Thereby manufacture of said refrigerator housing is simplified essentially.

In a particularly advantageous embodiment said external housing and said internal housing are injection-molded parts. This permits manufacture of a variety of different shapes of external housings and internal housings. In particular, it is possible to now form connecting parts, like e.g. a condensation water outlet or hinge elements, integrally with the housing parts. This also simplifies manufacture of the refrigerator housing, since it no longer is required to apply separate connection parts, by means of screwing e.g., to the housing.

In the connection between internal housing and external housing in a preferred embodiment a synthetic material joining method, ultra-sonic welding e.g., is used, thereby a safe and sealed connection of the two parts by fusing together of the synthetic materials during welding being guaranteed.

In a preferred embodiment of the invention the opening in the rear side of said external housing is covered by a cover plate for sealing the isolating hollow space. Preferably, the rear side of said external housing is completely open, i.e. the opening in said external housing is created by the side walls of said external housing.

As isolation material by which said hollow space between internal housing and external housing can be filled, vacuum isolation panels can be used, which have excellent isolating properties. However, it also is possible to use less expensive isolation material, like e.g. polyurethane foam and/or styrofoam and/or glass wool or similar materials with isolating properties.

In said external housing preferably one or several hinges or joint bushings, respectively, and/or pins, integrally formed with said external housing are provided for, which preferably serve for hanging up a refrigerator door. Said hinges therein in a preferred embodiment are formed as snap elements which permit latching of a hinge pin. Said snap elements have a double function, since on one hand they can be used as hinge bushings for a door or on the other hand as closing elements for the door, wherein for closing a corresponding pin of said refrigerator door latches in said snap element and thus locks the door. In addition or in alternative to the above-described integrated hinge elements which preferably are arranged in the upper region of said refrigerator housing, other and/or further hinges or hinge elements, respectively, can be provided for which are inset into said external housing in locking manner. Said hinges or hinge elements, respectively, preferably are arranged in the lower region of said refrigerator housing. By the interaction of an upper hinge with a lower hinge an axis of rotation is created around which said refrigerator door can be pivoted. Said hinges therein preferable are positioned in the corners of the front side of said refrigerator housing. The pivotal axis of a refrigerator door can thus be fixed by corresponding positioning of said lower and upper hinges in the right-hand or left-hand corners of said refrigerator housing and can in simple manner be exchanged by insetting the corresponding hinges or hinge elements, respectively, in the other housing corner.

In a preferred embodiment in which said upper hinges or hinge elements, respectively, are integrally formed in said external housing and said lower hinges or hinge elements, respectively, are given as inset elements, by simply changing inset of said lower hinge elements the axis of rotation of said refrigerator door can be shifted from one side to the other side. This in particular is also true when on said external housing not only snap elements are provided for as hinge elements but e.g. also pin elements for receiving hinge bushings of said refrigerator door, as lower insettable hinge members in particular. Of course, it is, however, possible to provide for any suitable combination of snap and pin elements, the above-described variations being advantageous because of their simple manufacturability and flexibility. In particular, is also is preferred to provide for a pin element as upper hinge element in form of a pin which is detachably inserted in a counterbore, since the corresponding snap element as hinge bushing in the lower region is better suited for receiving the weight of said refrigerator door.

Instead of the closing elements in form of snap elements and corresponding closure pins also other closing elements, like e.g. magnet arrangements, can be provided for.

In a further preferred embodiment of the invention a condensation water outlet for condensation water from the cooling compartment is integrally formed with said internal housing. Thus, it is no longer required after finishing of said refrigerator housing to provide for corresponding bores through said internal housing, said hollow space filled with isolation material and said external housing for a condensated water outlet. This also reduces manufacturing costs and subsequent cleaning of said refrigerator housing due to drilling chips occurring in drilling is not required. In addition, in said internal housing preferably recesses are provided for inserting supporting or carrying elements for the latter, wherein the goods to be cooled can be positioned on said support elements like e.g. drawers, glass plates or the like.

In a further embodiment said internal housing on its rear side has an opening into which the refrigerating unit of said refrigerator or parts thereof can be hung or passed through. In addition, said internal housing preferably is designed such that the electronics of said refrigerating unit or a component containing said electronics can be inset into said housing. Furthermore, said internal housing comprises a passage channel preferably formed integrally with said internal housing, a cable guide channel in particular, which serves for guidance of illumination cables. Thus, it is no longer required to fix corresponding cables to said internal housing and to seal them prior to filling said hollow space with isolation material. Consequently, manufacturing of said refrigerator housing is simplified.

The housing in a preferred embodiment further comprises an door connected to said external housing. Said door therein preferably is formed of injection-molded plastic material by an inside part and an outside part, which are mutually connected in sealed manner, welded together or glued together in particular. On said inside part a sealing or part of a sealing is provided for, in order to seal off the cooling compartment of said refrigerating housing by said door.

Said sealing between refrigerator door and housing can either be embodied as air chamber sealing, said elastic air chamber serving as sealing preferably being arranged on said refrigerator door. In particular, said sealing can also be embodied as integrated component of said door, injected therein in particular. This also is true for the case of air chamber sealing. In addition, however, also a sealing can be provided for which is pressed into a groove, wherein said sealing preferably comprises protrusions on the sides so that in cross-section they have the shape of a X-mas tree. If such sealing from an elastic material is pressed into a corresponding groove preferably on said housing, said lateral protrusions dig into said groove walls and thus form a reliable seal. Of course, the arrangement of said sealing or corresponding parts thereof on said door and said housing is exchangeable.

Furthermore, said door comprises hinge pins and/or hinge bushings for fixation thereof on said refrigerator housing. For guaranteeing good isolation properties of the door, it preferably like said housing is filled with isolation material, polyurethane foam in particular.

Further features, details and advantages of the invention will become evident from the following detailed description of an embodiment with reference to the attached drawing, wherein FIG. 1 shows a perspective front view of said internal housing of said refrigerator housing in accordance with the present invention;

Figure 1:
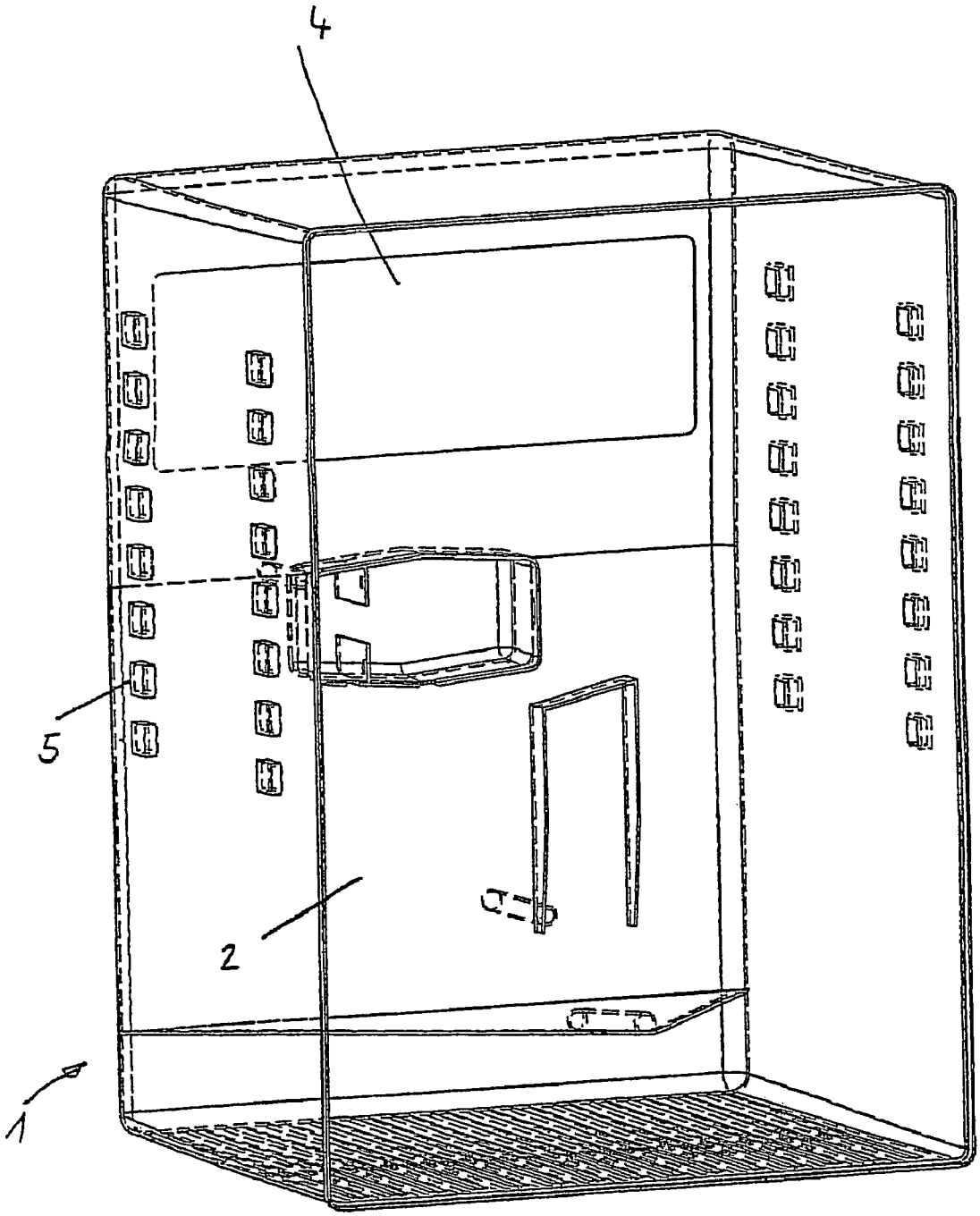
Figure 2:
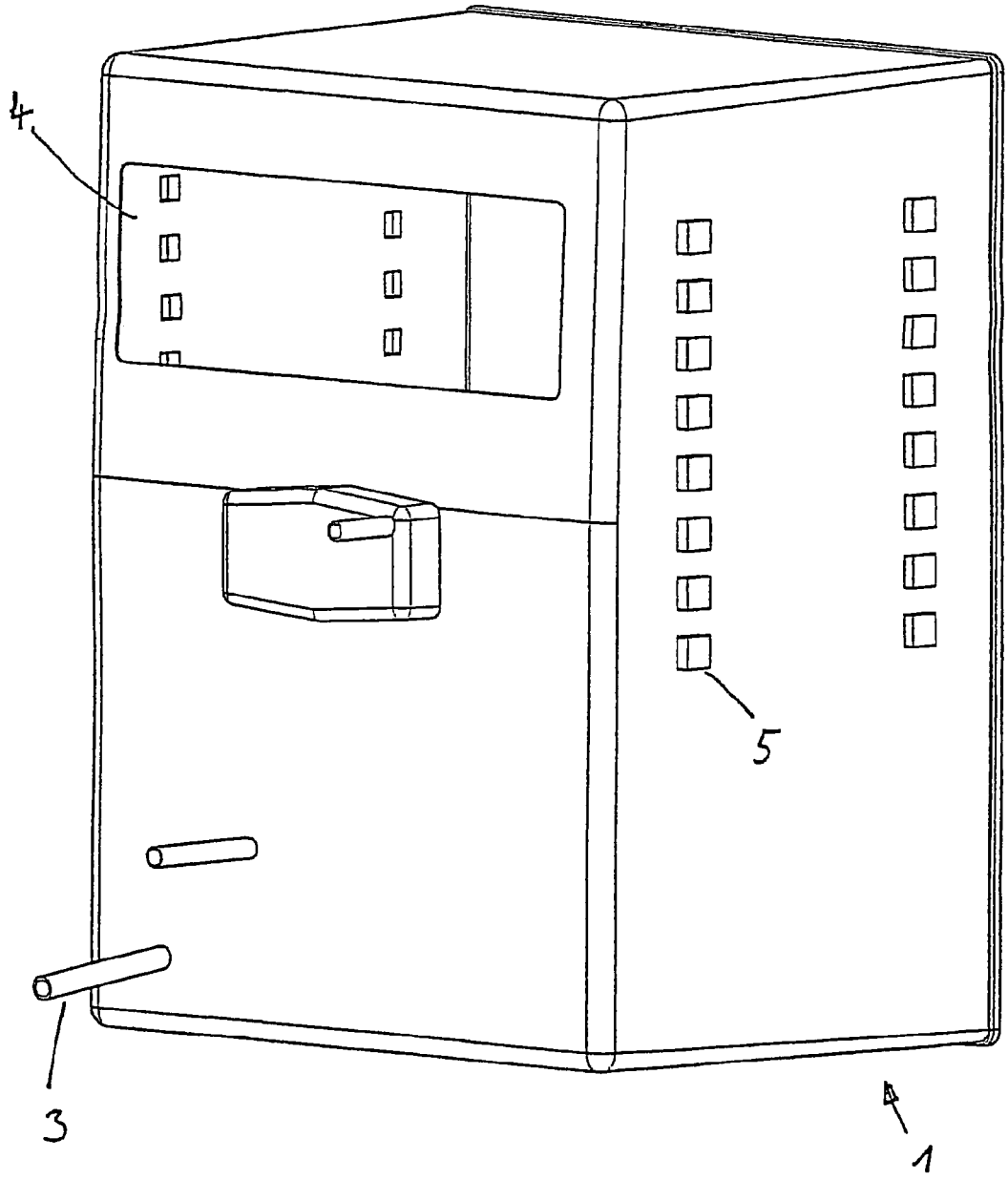
FIG. 2 shows a perspective rear view of said internal housing of FIG. 1.

The internal housing 1 of a preferred embodiment, shown in FIG. 1 is made from synthetic material and is manufactured by injection molding. Said internal housing is of essentially rectangular shape and has a front access opening 2. Said inside space of said internal housing in assembled condition of said refrigerator forms the cooling compartment in which the goods to be cooled are stored. Said internal housing on the side walls in addition comprises recesses 5 for insertion of deposit members which serve for storage of the goods to be cooled in said cooling compartment. As can be seen from FIG. 2 in particular, an opening 4 into which the refrigerating unit of said refrigerator can be hung is provided for on the rear side of said internal housing.

Furthermore, on the rear side of said internal housing a condensation water outlet 3 is arranged. Due to manufacture of said housing by injection molding said condensation water outlet can be integrally formed with said internal housing. Thus, it is no longer required to subsequently provided for breaking-through bores for condensation water drainage in the already assembled refrigerator housing, pollution of said refrigerator housing by drilling chips being avoided.

In accordance with a modification not shown, the rear side of said internal housing 1, however, can also be closed, wherein said refrigerating elements can be arranged behind said inside of said cooling compartment in particular in the hollow space between internal housing and external housing. E.g. said rear wall which is welded or glued to said external housing in the end of the manufacturing process for closing the opening in said external housing, said opening being provided for filling with isolation material, can comprise a passage through which the pipe connection between refrigerating elements arranged in the space between external housing and internal housing, and the remaining components of said refrigerator, e.g. an absorption refrigerating unit, can be passed. In such an embodiment the rear wall to be welded or glued thereto comprises means for hanging up said refrigerating unit or the parts, respectively, of said refrigerating unit to be arranged on the outside so that it can be hung in in simple manner. Using spacer ribs provided for on the outside of said rear wall said refrigerating unit is kept on distance to said rear wall. By foaming said passage of said rear wall and/or said space between rear wall, external housing and/or internal housing, respectively, said refrigerating unit in addition can be fixed in this position. Of course, as a matter of course also other possibilities of fixation are conceivable.

Figure 3:
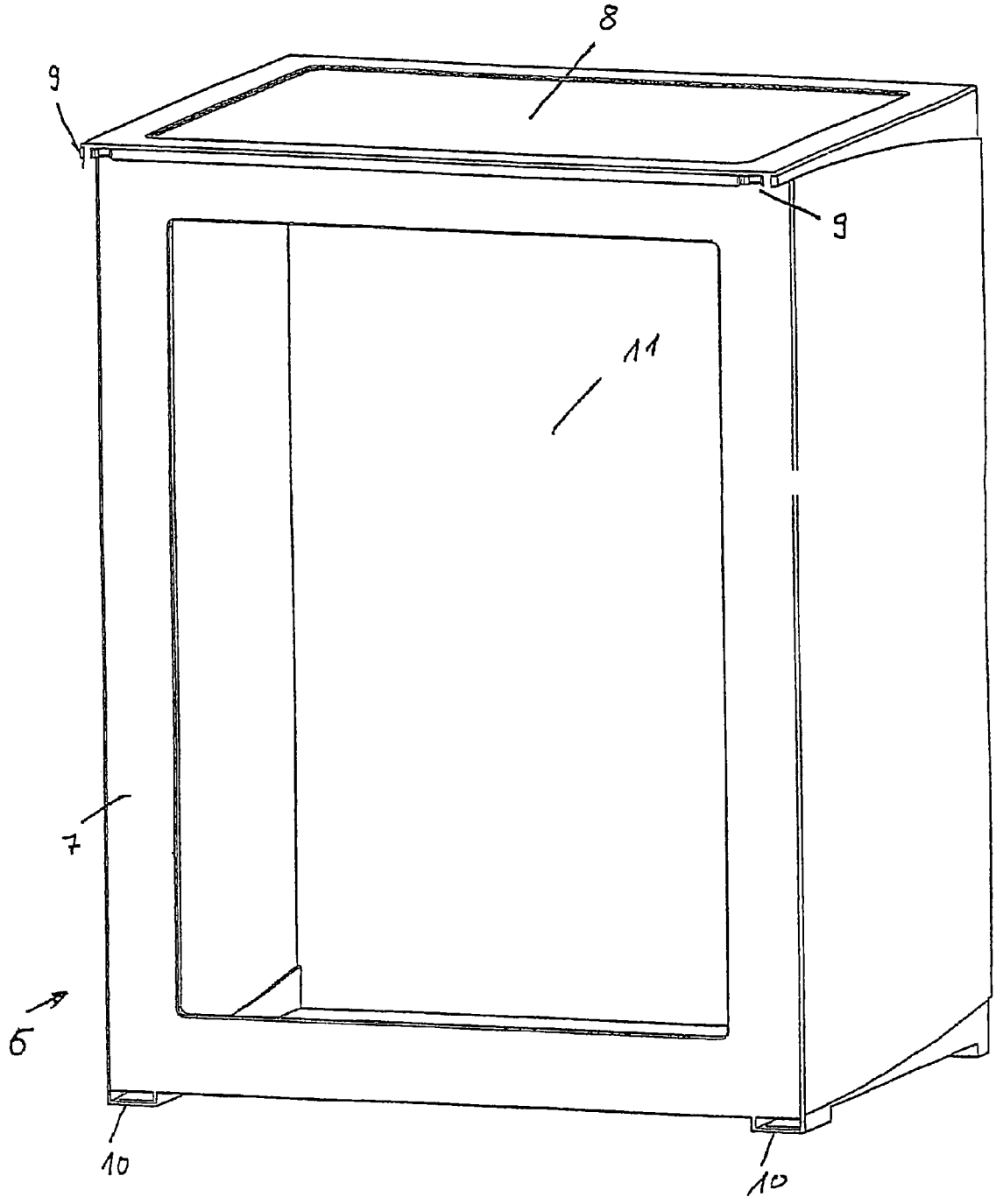
FIG. 3 shows a perspective front view of said external housing of said refrigerator housing in accordance with the present invention.
Figure 4:
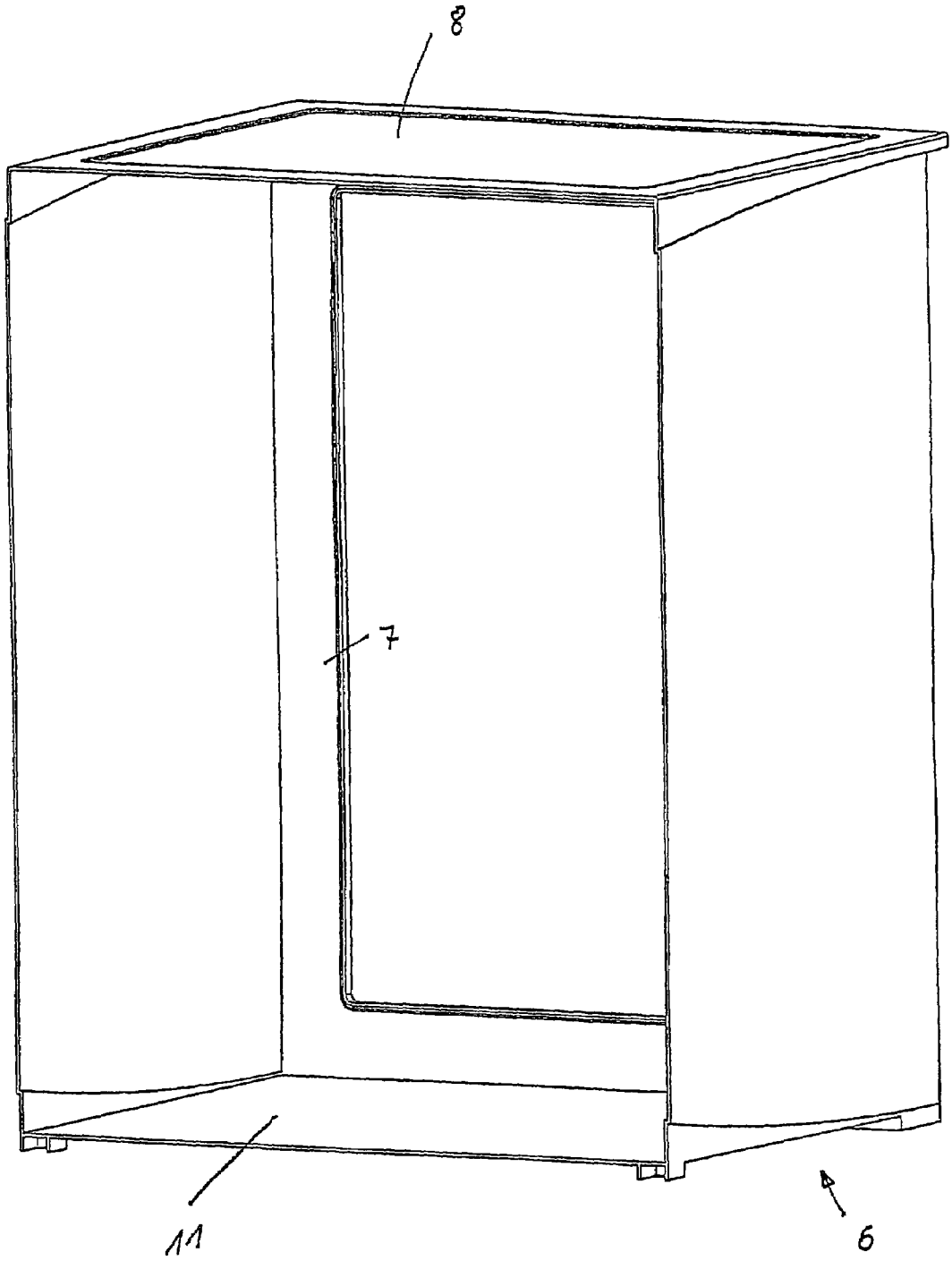
FIG. 4 shows a perspective rear view of said external housing of FIG. 1.
Figure 5:
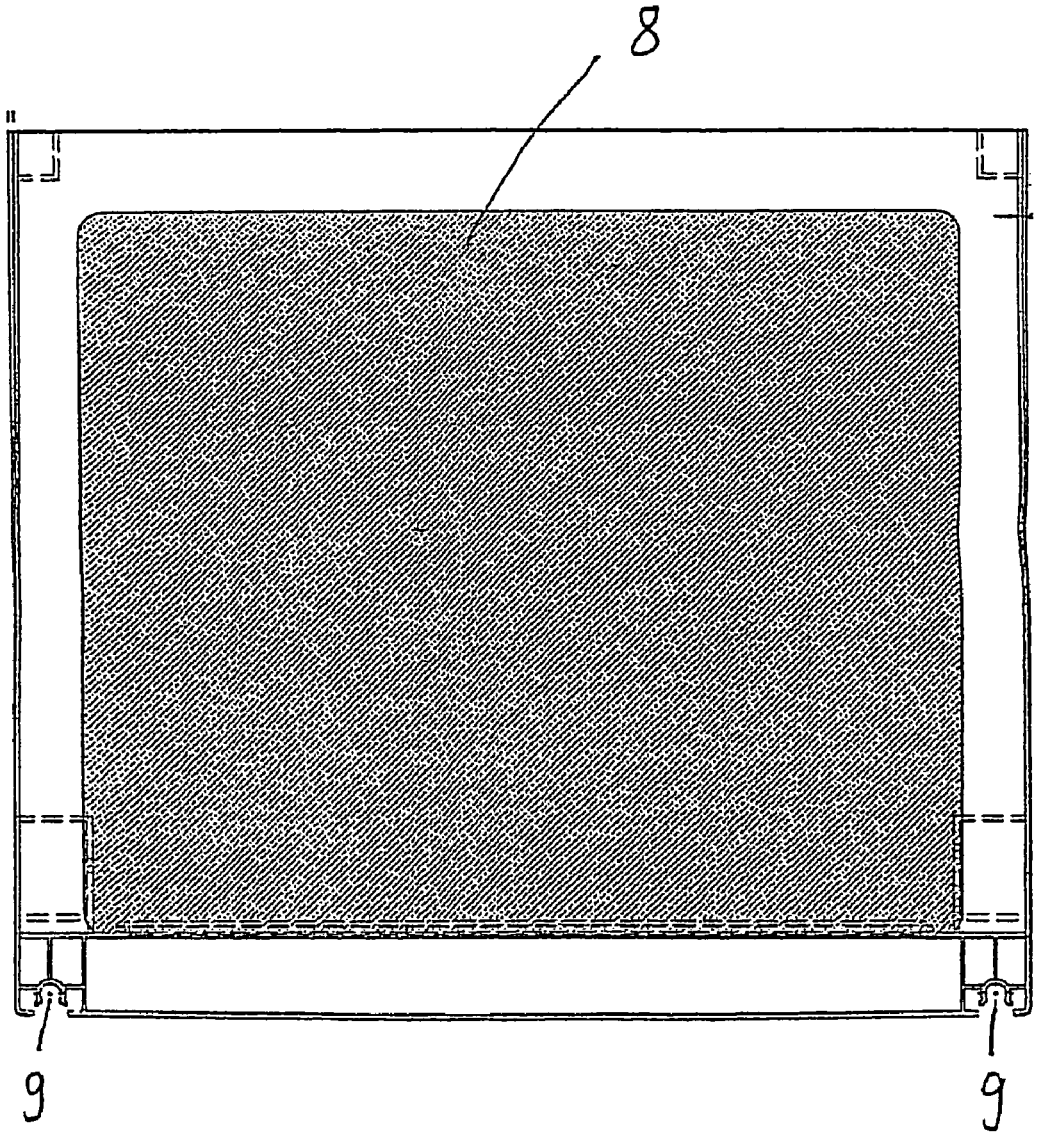
FIG. 5 shows a sectional view along the upper side of said external housing of FIG. 3.

From FIG. 3 a front view of said external housing of said refrigerator housing in accordance with the present invention is shown. Said external housing also consists of synthetic material and is manufactured by injection molding technology. Said external housing 6 on its front side comprises a circumferential rim 7. On the rear side said external housing 6 comprises an opening 11 formed by the side walls of said external housing, as can be seen from FIG. 4. Said rear side of said external housing thus is open and in the end of manufacture is closed with a rear wall which can also be welded or glued on. The upper side 8 of said external housing in its front region comprises two hinge bushings 9 which can be seen in more detail from the sectional view of FIG. 5. Said hinge bushings 9 are snap elements formed integrally or in one piece, respectively, with said housing, having semicircular elastic legs which on one side limit an opening, a so-called mouth, through which pins or studs with their longitudinal axis having an orientation perpendicular to the plane of drawing of FIG. 5 can be inserted or removed again. Into said snap elements said hinge pins of a door can be inserted. Said snap elements on one hand have the function of hinge bushings for guiding hinge pins and on the other hand can take over the function of a lock for locking hinge pins in these elements. In the lower region of said external housing furthermore guides 10 are provided for into which lower hinges or hinge elements, respectively, for connection with corresponding hinge elements of a door can be inset.

Figure 6:
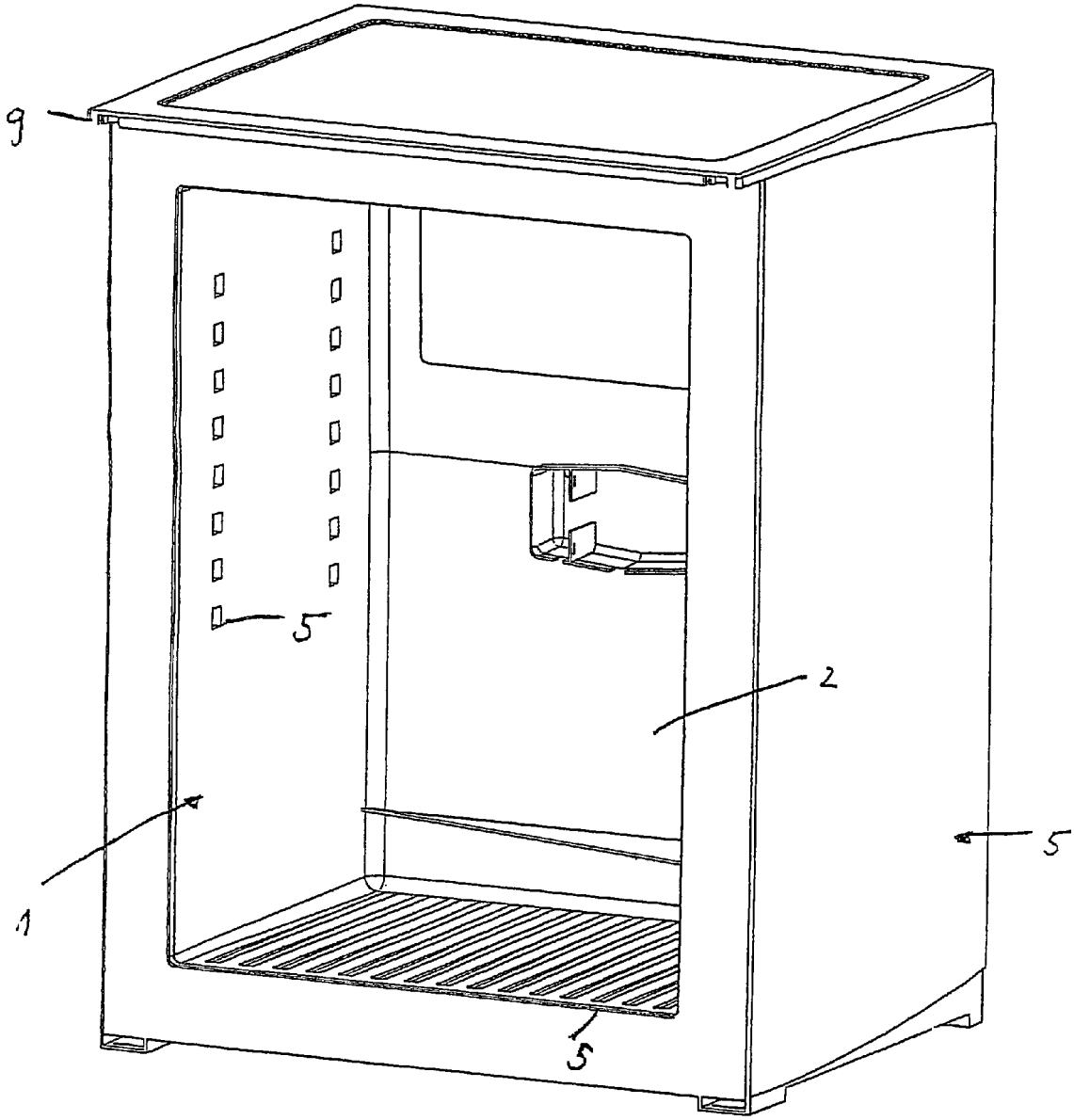
FIG. 6 shows a perspective front view of said refrigerator in accordance with the present invention, consisting of internal housing and external housing.
Figure 7:
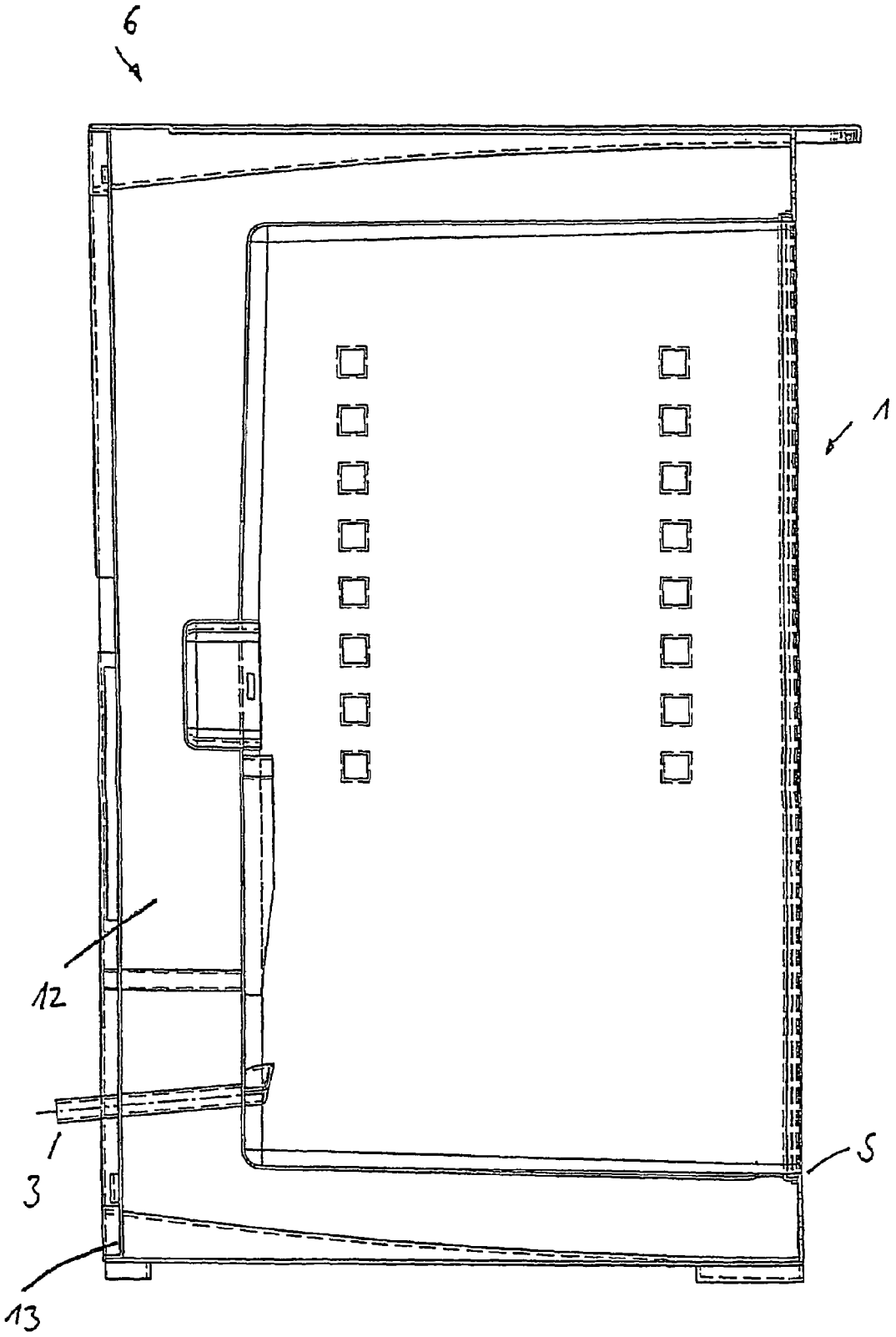
FIG. 7 shows a longitudinal section through said housing of FIG. 6.

From FIG. 6 a refrigerator housing in accordance with the present invention can be seen, wherein said internal and external housings described earlier now are welded together with one another by ultrasonic welding in the area of said access opening 2 along a welding seam S, wherein also other suitable joining methods are conceivable. For doing so said internal housing was inserted into said external housing through said rearward opening 11 thereof and subsequently welded together on the front side. Thereby a self-supporting housing was formed which then can be filled with isolation material through said opening 11 on the rear side. From the longitudinal section of FIG. 7 it can be seen that between internal housing 1 and external housing 6 a hollow space 12 is formed which is filled with isolation material, e.g. polyurethane foam, styrofoam, glass wool or similar materials with isolating properties. In this way simple manufacture of said refrigerator housing is rendered possible, since first of all a self-supporting housing is formed whose shape already defines the filling space for the isolation material. Thus, internal housing and external housing need not to be kept at a relative position with respect to one another during filling. Said hollow space 12 then again is closed from the rear side with a cover plate or rear wall 13. In said cover plate a corresponding opening is located for the condensation water outlet 3.

Figure 8:
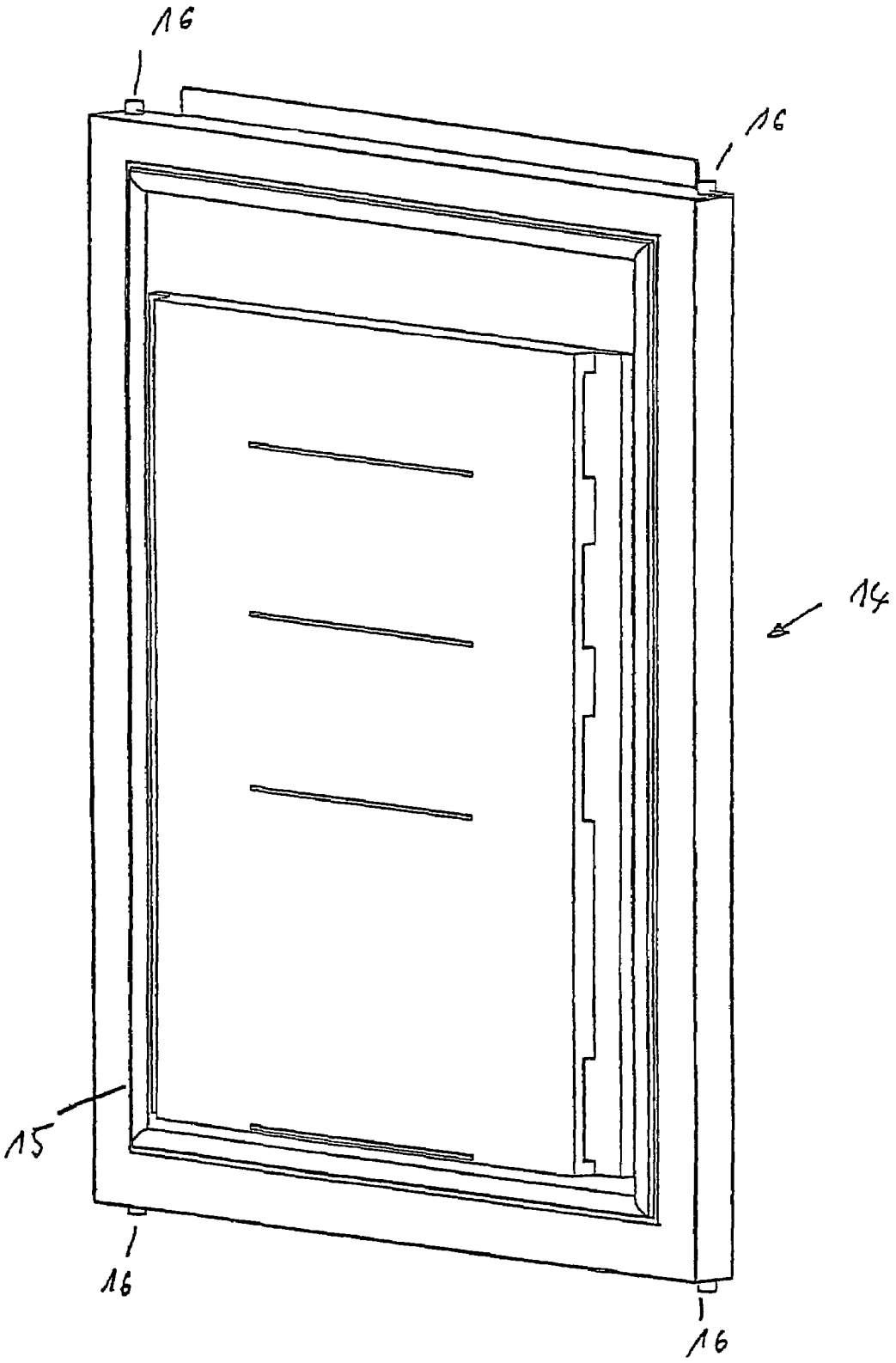
FIG. 8 shows a perspective view of the inside of a refrigerator door of said refrigerator housing in accordance with the present invention and FIG. 9 shows a cross-section through said door of FIG. 8.
Figure 9:
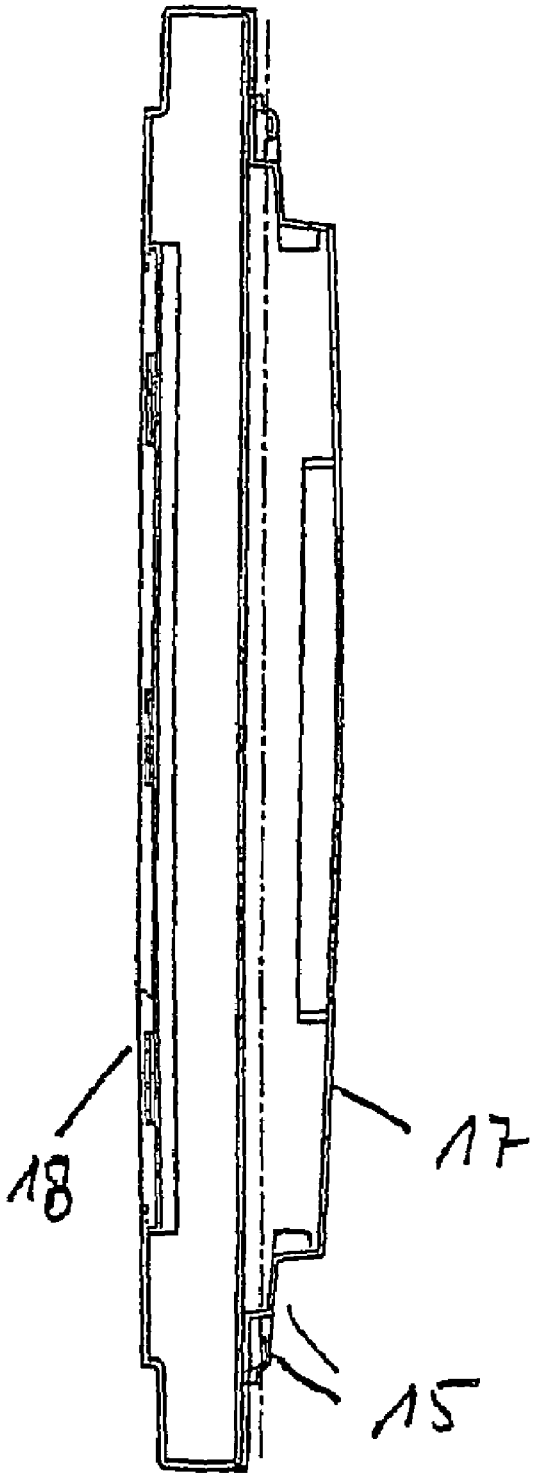

From FIG. 8 a perspective view of the inside of a refrigerator door can be seen, which can be hung into said refrigerator housing in accordance with the present invention. For this purpose said door in its corners has hinge pins 16 which cooperate with said snap elements 9 of said external housing. Said door consists of injection-molded synthetic material, a sealing 15 being injected to said inside for sealing of said cooling compartment. As sealing element herein air chamber seals or other elastic seals can be used, which also can be put or glued on and which can engage with an opposing groove in particular. As can be seen from the sectional view of FIG. 9, said door includes an injection-molded inside part 17 and an injection-molded outside part 18 which are welded together by ultrasonic welding. From FIG. 9 in addition the sealing 15 applied by injection molding can be seen. The hollow space between inside part 17 and outside part 18 preferably is filled with isolation material, e.g. polyurethane foam or similar materials.

The invention claimed is:

1. Refrigerator housing including an one-piece external housing made (6) from synthetic material;

an internal housing (1) made from synthetic material, which forms a cooling compartment and comprises an access opening (2);

said external housing (6) and said internal housing (1) being in sealed manner connected to one another in the region of said access opening (2) on the front side, welded together or glued together in particular, and a hollow space (12) serving for isolation being formed between internal housing (1) and external housing (6);

said external housing (6) on its rear side comprises an opening (11) through which essentially the entire hollow space is accessible for introducing isolation material, said external housing (6) and said internal housing (1) being injection-molded components.

2. Refrigerator housing as defined in claim 1, characterized in that said internal housing (1) and said external housing (6) are connected to one another by a synthetic material joining method, ultrasonic welding in particular.

3. Refrigerator housing as defined in one of the preceding claims, characterized in that said opening (11) in said external housing (6) is covered by a cover plate (13).

4. Refrigerator housing as defined in claim 1, characterized in that said opening (11) in said external housing (6) is formed by the side walls of said external housing (11).

5. Refrigerator housing as defined in claim 1, characterized in that said hollow space (12) is filled with isolation material, in particular in dependence on the case of application with vacuum panels, styrofoam, polyurethane foam or a combination thereof.

6. Refrigerator housing as defined in claim 5, characterized in that said isolation material includes vacuum isolation panels.

7. Refrigerator housing as defined in claim 5, characterized in that said isolation material includes polyurethane foam and/or styrofoam and/or glass wool.

8. Refrigerator housing as defined in claim 1 characterized in that one or several hinges or hinge elements (9) are provided for on said external housing (6).

9. Refrigerator housing as defined in claim 8, characterized in that said hinge element or elements (9) are snap elements and/or pins.

10. Refrigerator housing as defined in claim 8 or 9, characterized in that said hinge element or elements are integrally formed with said external housing (6) or are provided for as inset elements.

11. Refrigerator housing as defined in claim 1, characterized in that said a condensation water outlet (3) integrally formed with said internal housing (1) is provided for.

12. Refrigerator housing as defined in claim 1, characterized in that said internal housing comprises recesses (5) for insertion of deposition elements and/or carrier elements (strips) for those.

13. Refrigerator housing as defined in claim 1, characterized in that said internal housing (1) on its rear side has an opening (4) for hanging in or passing through a refrigerating unit or at least a part of said refrigerating unit.

14. Refrigerator housing as defined in claim 1, characterized in that said the electronics of a refrigerating unit or a component including electronics can be inset into said refrigerator housing.

15. Refrigerator housing as defined in claim 1, characterized in that at least one passage channel integrally formed with said internal housing (1), for passage of illumination cables in particular, is provided for.

16. Refrigerator housing as defined in claim 1, characterized in that a door (14) connected to said external housing (6) is provided for.

17. Refrigerator housing as defined claim 16, characterized in that said door (14) includes an inside part (17) and an outside part (18) from injection-molded synthetic material, which are welded or glued to one another.

18. Refrigerator housing as defined claim 17, characterized in that on said inside part (17) a sealing (15), injection-molded thereto in particular, is provided for.

19. Refrigerator housing as defined claim 17 or 18, characterized in that between said inside part (17) and said outside part (18) isolation material, polyurethane foam in particular, is provided for.

20. Refrigerator housing as defined in one of the claims 16, characterized in that said door (14) in its corners comprises hinge pins (16).

* * * * *